US011155053B2

(12) United States Patent
Ceci

(10) Patent No.: US 11,155,053 B2
(45) Date of Patent: Oct. 26, 2021

(54) METHOD FOR FORMING AN OPENED DIE-CUT ELEMENT, PARTICULARLY FOR FORMING A WRAP-AROUND BOX OF THE TRAY PLUS LID TYPE, AND A CARTONING MACHINE

(71) Applicant: TIBER PACK S.P.A, Sansepolcro (IT)

(72) Inventor: Maurizio Ceci, Sansepolcro (IT)

(73) Assignee: TIBER PACK S.P.A, Sansepolcro (IT)

( * ) Notice: Subject to any disclaimer, the term of this patent is extended or adjusted under 35 U.S.C. 154(b) by 138 days.

(21) Appl. No.: 16/498,228

(22) PCT Filed: Mar. 28, 2018

(86) PCT No.: PCT/IB2018/052119
§ 371 (c)(1),
(2) Date: Sep. 26, 2019

(87) PCT Pub. No.: WO2018/178891
PCT Pub. Date: Oct. 4, 2018

(65) Prior Publication Data

US 2020/0023604 A1 Jan. 23, 2020

(30) Foreign Application Priority Data

Mar. 28, 2017 (IT) ..... 102017000033740

(51) Int. Cl.
*B31B 50/14* (2017.01)
*B31B 50/06* (2017.01)
(Continued)

(52) U.S. Cl.
CPC ..... *B31B 50/142* (2017.08); *B31B 50/06* (2017.08); *B31B 50/07* (2017.08); *B31B 50/20* (2017.08);
(Continued)

(58) Field of Classification Search
CPC ..... B65B 5/02; B31B 50/002; B31B 50/06; B31B 50/07; B31B 50/14; B31B 50/142;
(Continued)

(56) References Cited

U.S. PATENT DOCUMENTS 3,656,417 A * 4/1972 Scully ..... B31B 50/00 493/131
4,396,115 A * 8/1983 Watson ..... B65D 5/52 229/102.5
(Continued)

FOREIGN PATENT DOCUMENTS

EP 2692517 A2 * 7/2012 ..... B31B 1/00
EP 2692517 A2 * 2/2014 ..... B31B 1/00
WO 2007103176 A2 9/2007

*Primary Examiner* — Hemant Desai
*Assistant Examiner* — Jacob A Smith
(74) *Attorney, Agent, or Firm* — R. Neil Sudol; Henry D. Coleman

(57) ABSTRACT

A main die-cut element is divided along a predefined division line to obtain a first die-cut element and a distinct second die-cut element. Glue is deposited on a first portion of one from between the first die-cut element and a secondary die-cut element and on a second portion of one from between the second die-cut element and the secondary die-cut element. The method includes forming an opened die-cut element of the tray plus lid type given by the combination of the first die-cut element and the second die-cut element, wherein these two elements are coupled to the secondary die-cut element, with the first die-cut element and the secondary die-cut element partly superposed and pressed to one another at the first portion and the second die-cut element and the secondary die-cut element being partly superposed and pressed together at the second portion.

11 Claims, 12 Drawing Sheets

(51) Int. Cl.

| | |
|---|---|
| ***B31B 50/07*** | (2017.01) |
| ***B31B 50/20*** | (2017.01) |
| ***B31B 50/25*** | (2017.01) |
| ***B31B 50/62*** | (2017.01) |
| *B31B 110/35* | (2017.01) |
| *B31B 120/10* | (2017.01) |

(52) U.S. Cl.
CPC ..... *B31B 50/25* (2017.08); *B31B 50/624* (2017.08); *B31B 2110/35* (2017.08); *B31B 2120/10* (2017.08)

(58) Field of Classification Search
CPC ..... B31B 50/20; B31B 50/25; B31B 50/252; B31B 50/592; B31B 50/624; B31B 2105/00; B31B 2110/35; B31B 2120/10
USPC ..... 493/52, 59, 84, 143, 144, 145
See application file for complete search history.

(56) References Cited

U.S. PATENT DOCUMENTS 5,224,919 A * 7/1993 Walsh ..... B31B 50/00 493/110
8,621,831 B2 * 1/2014 Moylan ..... B65B 39/06 53/504
10,144,191 B2 * 12/2018 Menegazzi ..... B31D 5/0004
10,350,849 B2 * 7/2019 Graham ..... B31B 50/64
2004/0023768 A1 2/2004 Jaen
2004/0084350 A1 * 5/2004 Kim ..... B65D 5/4208 206/736
2007/0204567 A1 * 9/2007 Wintring ..... B65B 5/024 53/452
2009/0286663 A1 * 11/2009 Little ..... B65D 5/566 493/116
2010/0120594 A1 * 5/2010 Little ..... B65D 5/0075 493/56
2013/0045847 A1 * 2/2013 Capoia ..... B26D 7/2635 493/59
2013/0108408 A1 * 5/2013 Saison ..... B65H 3/46 414/797
2013/0137563 A1 * 5/2013 Mathieu ..... B31B 1/26 493/162
2014/0135196 A1 * 5/2014 Berglin ..... B65B 5/028 493/416
2019/0135482 A1 * 5/2019 Pratsch ..... B65D 5/4608
2019/0225365 A1 * 7/2019 Couture ..... B31B 50/624
2021/0031968 A1 * 2/2021 Valencia ..... B65D 5/24

* cited by examiner

METHOD FOR FORMING AN OPENED DIE-CUT ELEMENT, PARTICULARLY FOR FORMING A WRAP-AROUND BOX OF THE TRAY PLUS LID TYPE, AND A CARTONING MACHINE

FIELD OF THE INVENTION

The present invention relates to a method for forming a die-cut element, particularly for forming a wrap-around box of the tray plus lid type, and the cartoning machine with which to realise the method.

DESCRIPTION OF THE PRIOR ART

Today there exist wrap-around packagings constituted by an opened die-cut element, made of cardboard or another like material, obtained as the sum of two or more sheet elements, distinct from one another and typically being two or three elements, and appropriately glued so as to give rise to a packaging constituted by a lower part, a display tray, able to contain the products, and an upper part, the lid, which is removable from the lower part in such a way as to enable displaying the products once the packaging is placed on a shelf/plane of the sales point.

The opened die-cut element has been conceived to be handled in automatic cartoning machines for closing the die-cut element from the open state to the closed state directly about the product, for which reason it is termed "wrap-around", according to a sequence of predetermined steps.

These machines therefore substantially include: a cartons store for each sheet element to be processed, gripping means and management means of the single element associated to the single store, a gluing station of the single elements for obtaining the opened die-cut element, a filling and forming station of the opened die-cut element previously obtained about the products inserted therein.

These cartoning machines of known type are not free of drawbacks among which the fact that for each reference assembled packaging there is a number of component codes equal to the number of the elements constituting the finished packaging.

This has a negative effect on the complexity of management of the elements, both when put up for sale or stored, as well as on the operating management of the materials in all the productive steps.

In fact, the devices of the assembly machine and the complication thereof proportionally increase with the number of elements to be assembled.

In greater detail, the machines must have a number of stores equal to the number of sheet elements that make up the packaging, with a consequent growing number of devices for gripping the sheet elements from the carton store, for controls, guiding and gluing the single elements.

SUMMARY OF THE INVENTION

The main aim of the present invention consists in providing a forming method of a die-cut element, particularly for forming a wrap-around box of the tray plus lid type, which enables obviating the above-mentioned drawback by reducing the number of stores and devices connected thereto in relation to the number of sheet elements which will go to make up the final packaging.

In the context of this task, an aim of the present invention consists in realising a cartoning machine able to carry out the above process, being structurally and functionally simpler than the machines of known type, so as to be at the same time economically advantageous with respect thereto.

A further aim of the present invention consists in the fact of realising a cartoning machine that offers the broadest guarantees of functioning and reliability.

This task, as well as these and other aims which will emerge more fully in the following, are attained by a forming process of a die-cut element, particularly for the formation of a wrap-around box of the tray plus lid type, in accordance with claim 1.

Furthermore, the task, as well as these and other alms that will more fully emerge in the following, are attained using a cartoning machine according to claim 5.

BRIEF DESCRIPTION OF THE DRAWINGS

Further characteristics and advantages of the invention will more fully emerge from the description of a preferred but not exclusive embodiment of a method for forming a die-cut element, particularly for forming a wrap-around box of the tray plus lid type, and a cartoning machine with which to realise the method, according to the invention, illustrated by way of non-limiting example in the accompanying drawings, in which FIGS. 1 to 7, 3A, 3B, 3C and 3D schematically illustrate the steps in sequence of a cartoning machine operating according to the method of the invention for obtaining an opened die-cut element formed by three pieces.

DESCRIPTION OF THE PREFERRED EMBODIMENTS

With particular reference to the accompanying figures, the method for forming a die-cut element, particularly for forming a wrap-around box of the tray plus lid type, according to the present invention, in the embodiment described is substantially made up of a series of steps, described in sequence in the following.

Figure 1:
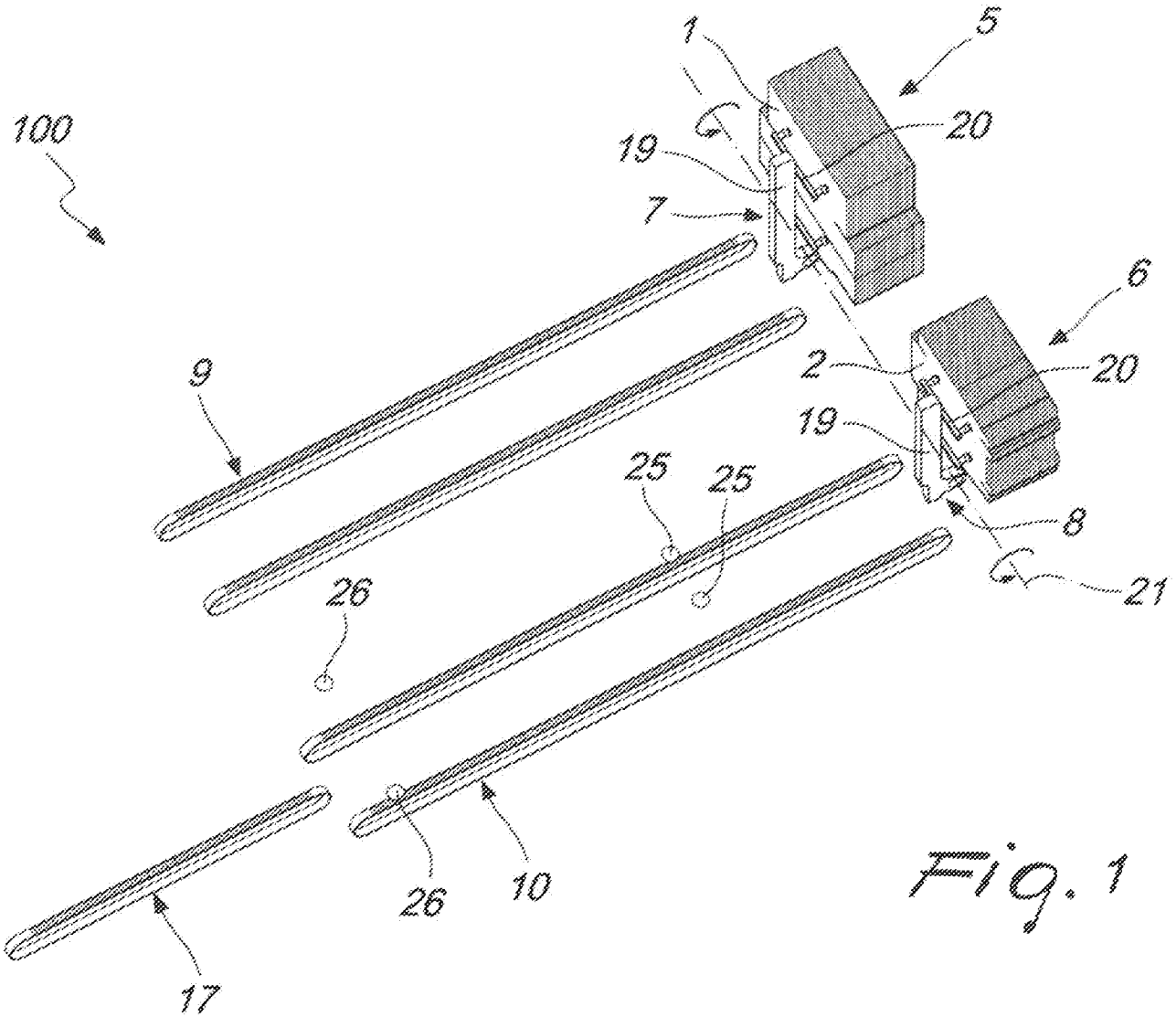

With particular reference to FIG. 1, there is first a step of providing a main die-cut element (1) and a secondary die-cut element (2).

As will be more fully described in the following, with particular reference to FIG. 2, the die-cut elements (1 and 2) are collected from two respective stores (5 and 6) located, for example, parallel to one another and, by use of appropriate pick up and discharge devices (7 and 8), are deposited on two advancement lines (9 and 10), for example also parallel to one another.

Figure 3:
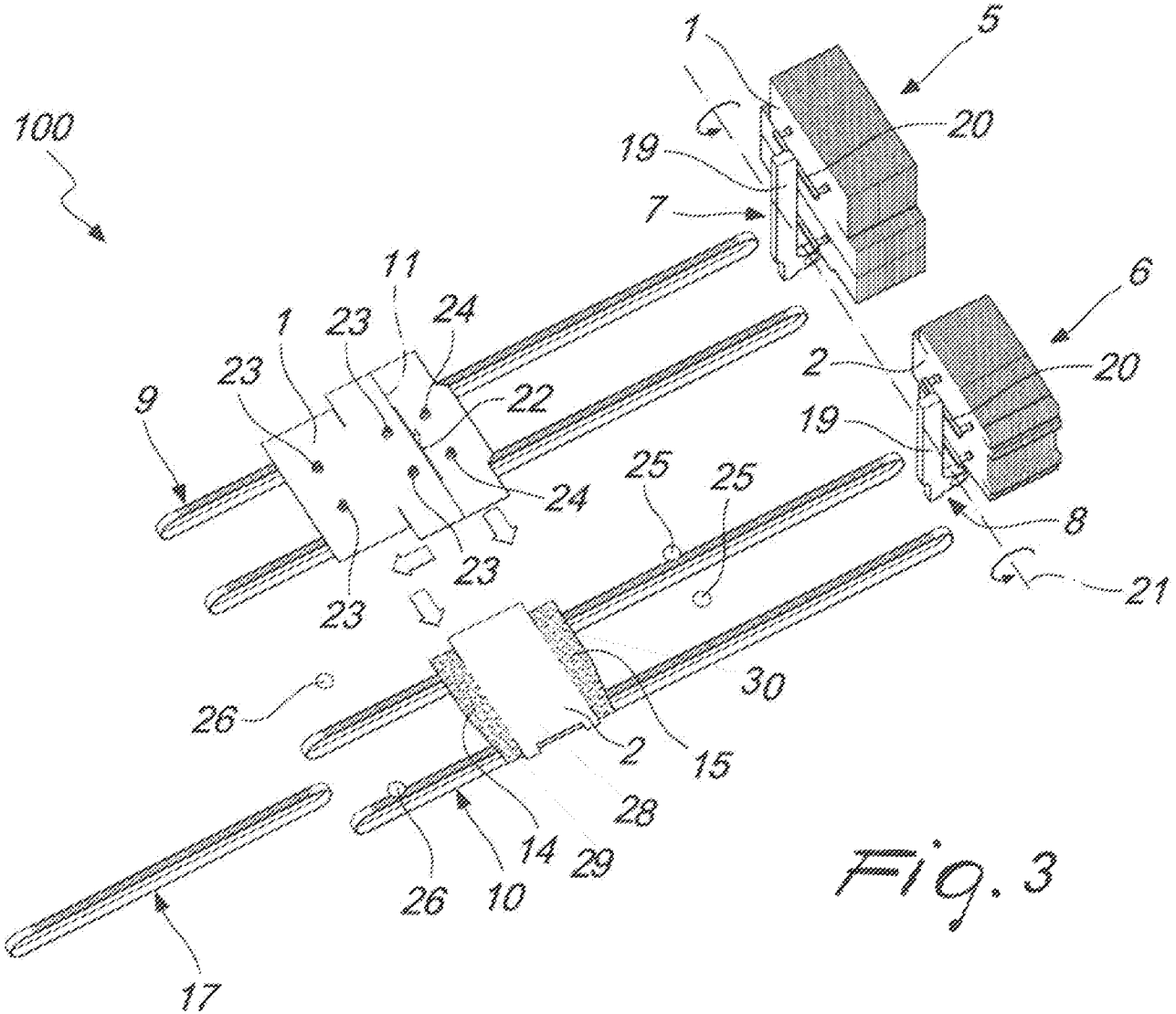
Figure 3A:
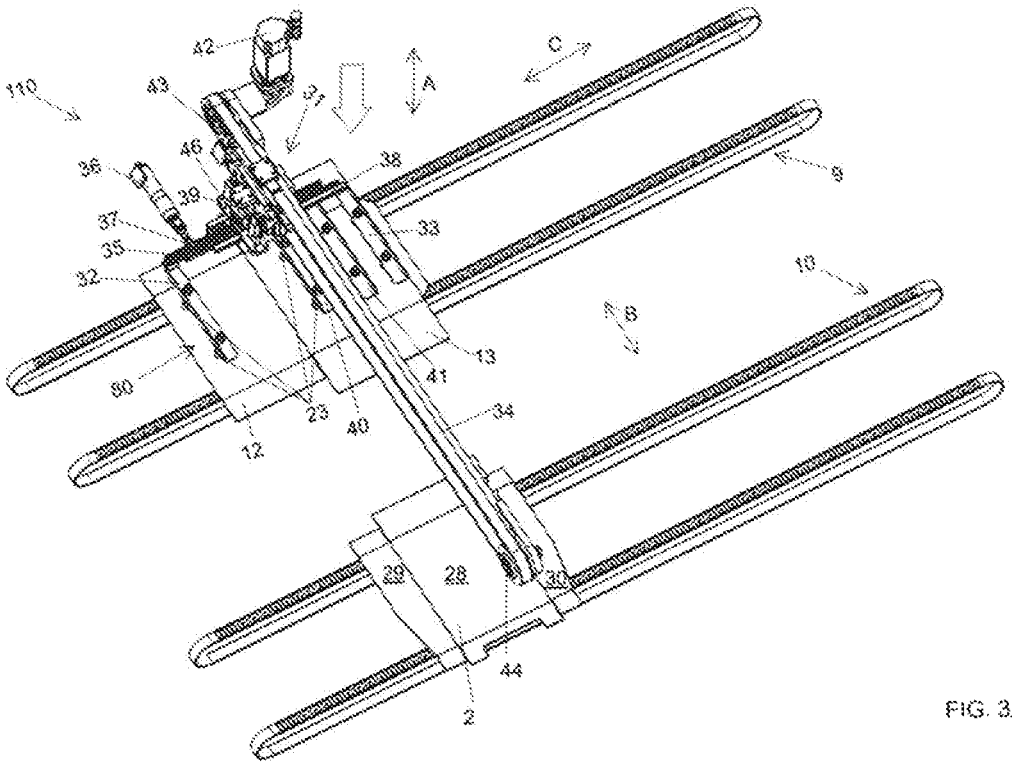
Figure 3B:
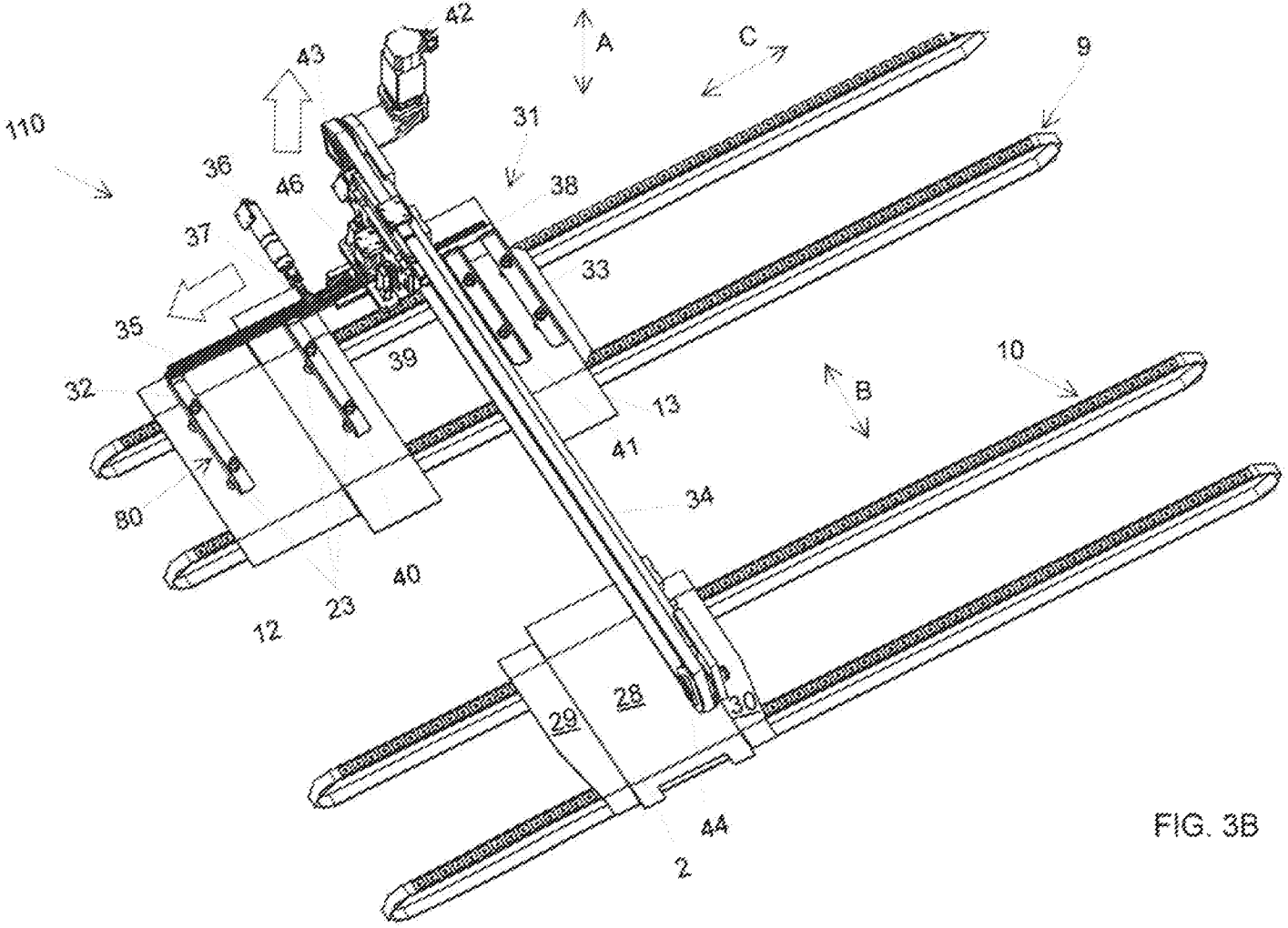
Figure 3C:
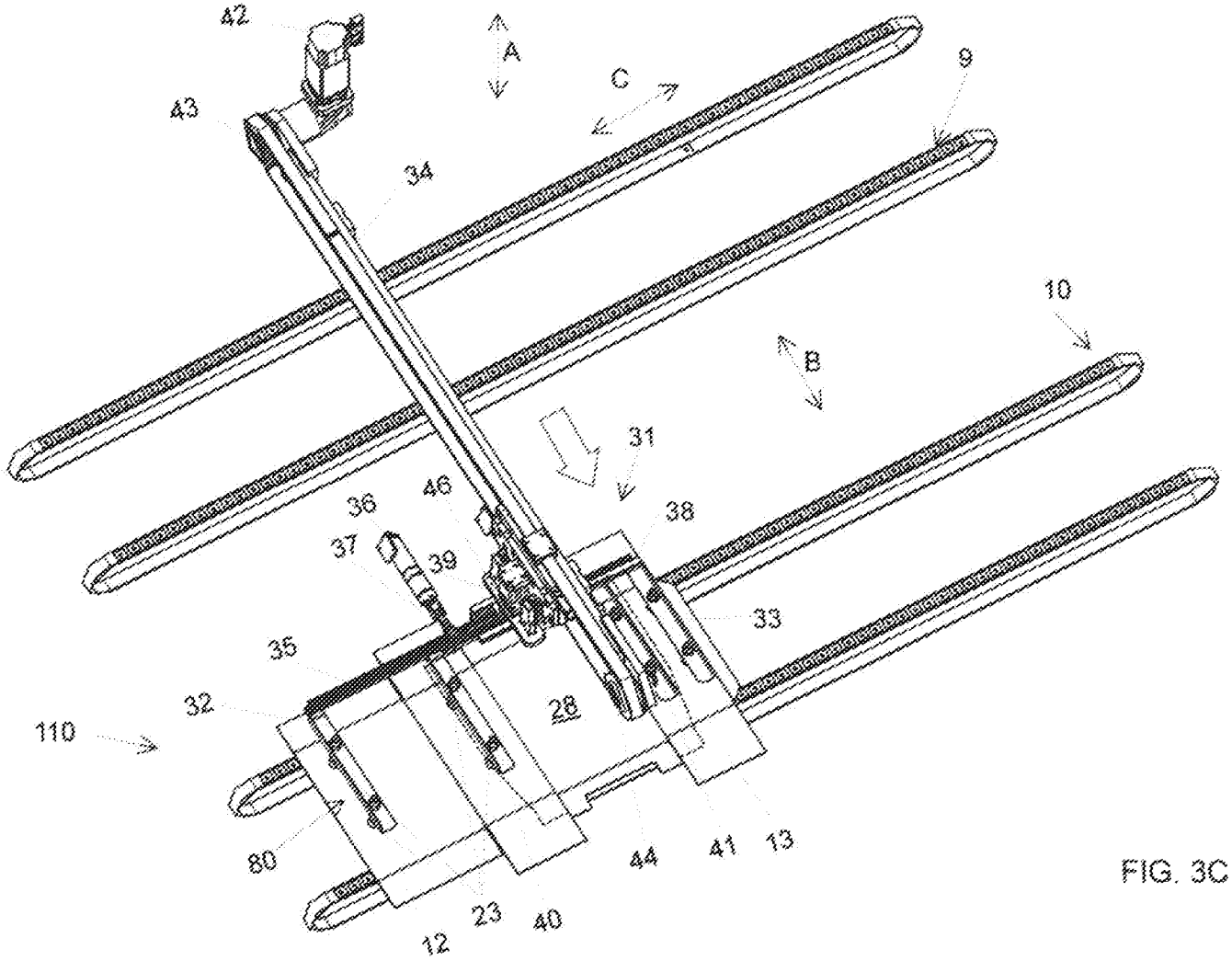
Figure 3D:
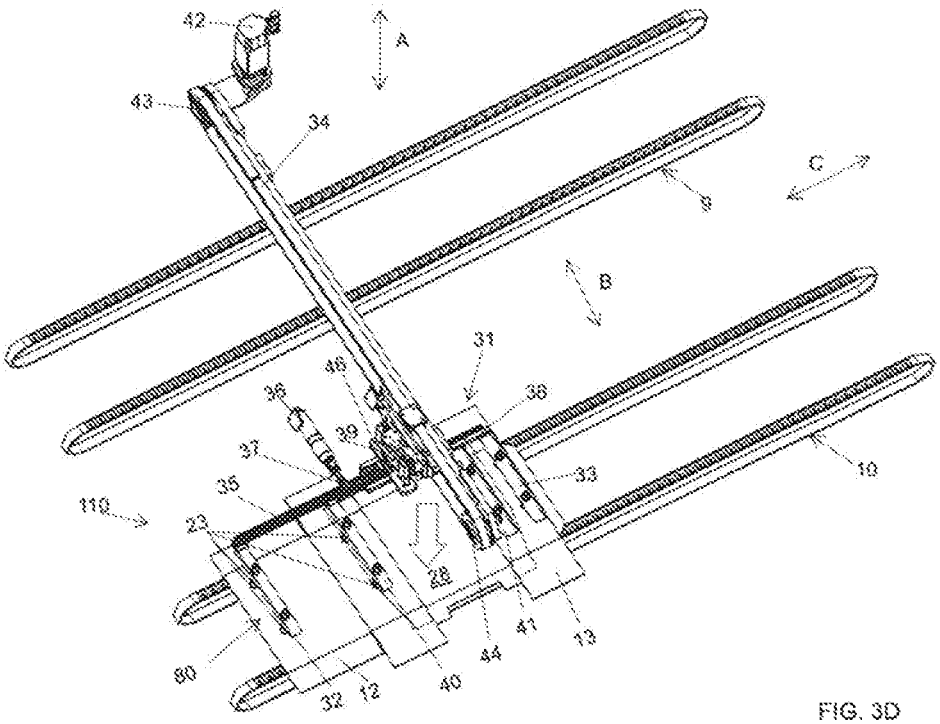

Thereafter, with particular reference to FIG. 3, a division step of the main de-cut element (1) along a predefined division line (11) takes place, in such a way as to obtain a first die-cut element (12) and second die-cut element (13) that are mutually distinct.

In greater detail, in the present embodiment, the division step comprises the cutting of the main die-cut element (1) along the predefined division line (11).

The division step can alternatively comprise the tearing of the main die-cut element (1) along the predefined division line (11). In this case, the main die-cut element (1) is partially pre-cut along the predefined division line (11) so as to facilitate tearing.

With the aim of enabling correct separation of the two die-cut elements (12, 13), grip and contrast means (80) can advantageously be included which will be more fully described in the following, which are adapted to retain said main die-cut element (1) during division thereof into the first die-cut element (12) and into the second de-cut element (13).

At the same time as or immediately following the division step described in the foregoing, a step is advantageously included of depositing glue on a first portion (14) of one from between the first die-cut element (12) and the secondary die-cut element (2) and on a second portion (15) of one from between the second die-cut element (13) and the secondary die-cut element (2).

Figure 4:
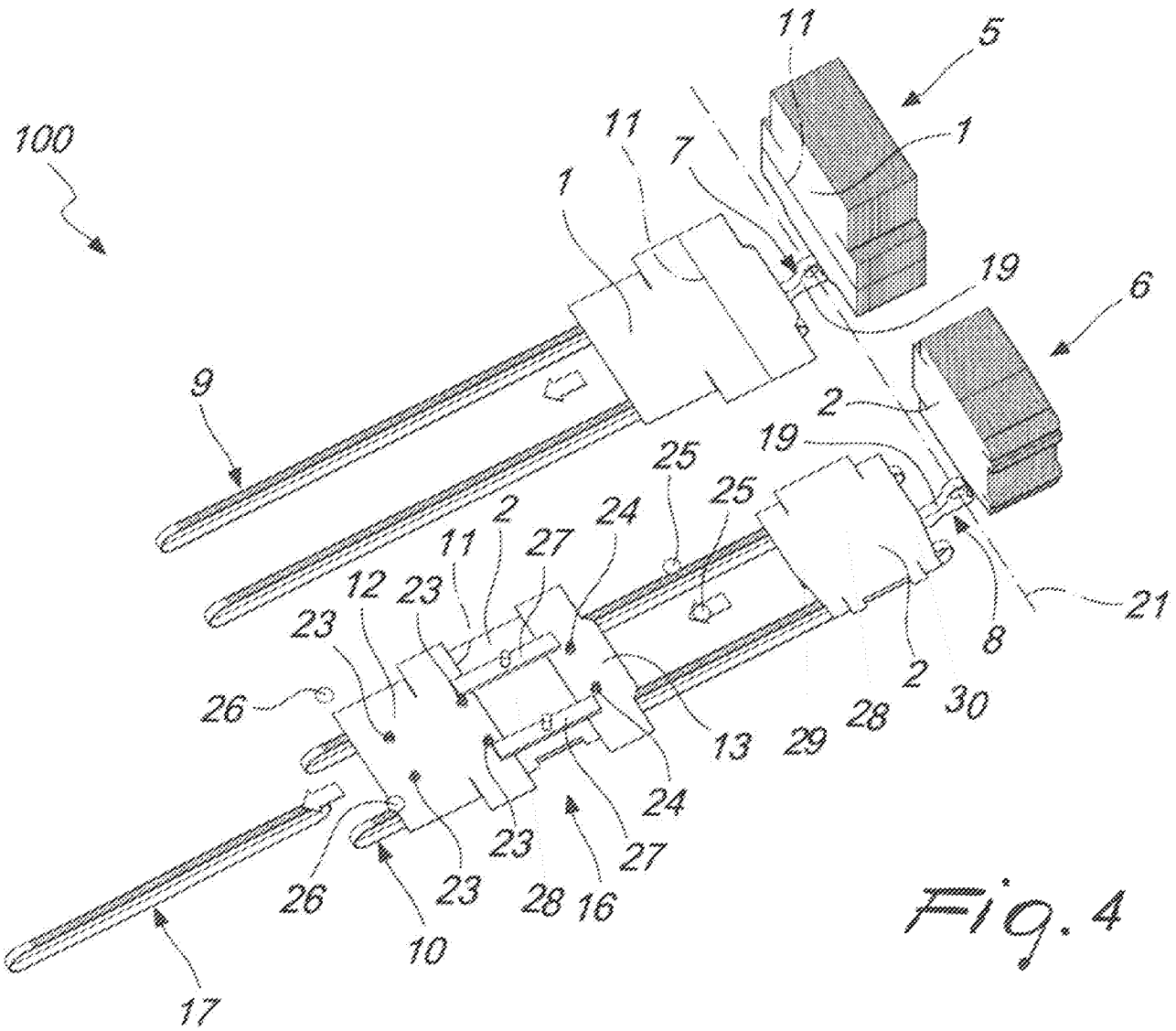

Thereafter, as illustrated in FIG. 4, there is the step of forming an opened die-cut element (16) of the tray plus lid type given by the combination of the first die-cut element (12) and the second die-cut element (13).

In greater detail, in the illustrated embodiment, the first die-cut element (12) and the second die-cut element (13) are coupled to the secondary die-cut element (2) with the first die-cut element (12) and the secondary die-cut element (2) partly superposed and pressed to one another at the first portion (14) and with the second die-cut element (13) and the secondary die-cut element (2) partly superposed and pressed to one another at the second portion (15).

The secondary die-cut element (2), preferably, comprises: a central portion (28); a first lateral portion (29); and a second lateral portion (30), opposite the first lateral portion (29). Further, the first die-cut element (12) preferably couples with the secondary die-cut element (2) by means of relative superposing between the first die-cut element (12) and the first lateral portion (29); and the second die-cut element (13) couples with the secondary die-cut element (2) by means of relative superposing between the second die-cut element (13) and the second lateral portion (30), see in particular FIG. 2.

In other words, the first die-cut element (12) can be superposed on the secondary die-cut element (2) at the first lateral portion (29); alternatively, the secondary die-cut element (2) can be superposed on the first die-cut element (12) at the first lateral portion (29). Likewise, the second die-cut element (13) can be superposed on the secondary die-cut element (2) at the second lateral portion (30); alternatively, the secondary die-cut element (2) can be superposed on the second die-cut element (13) at the second lateral portion (30).

Figure 5:
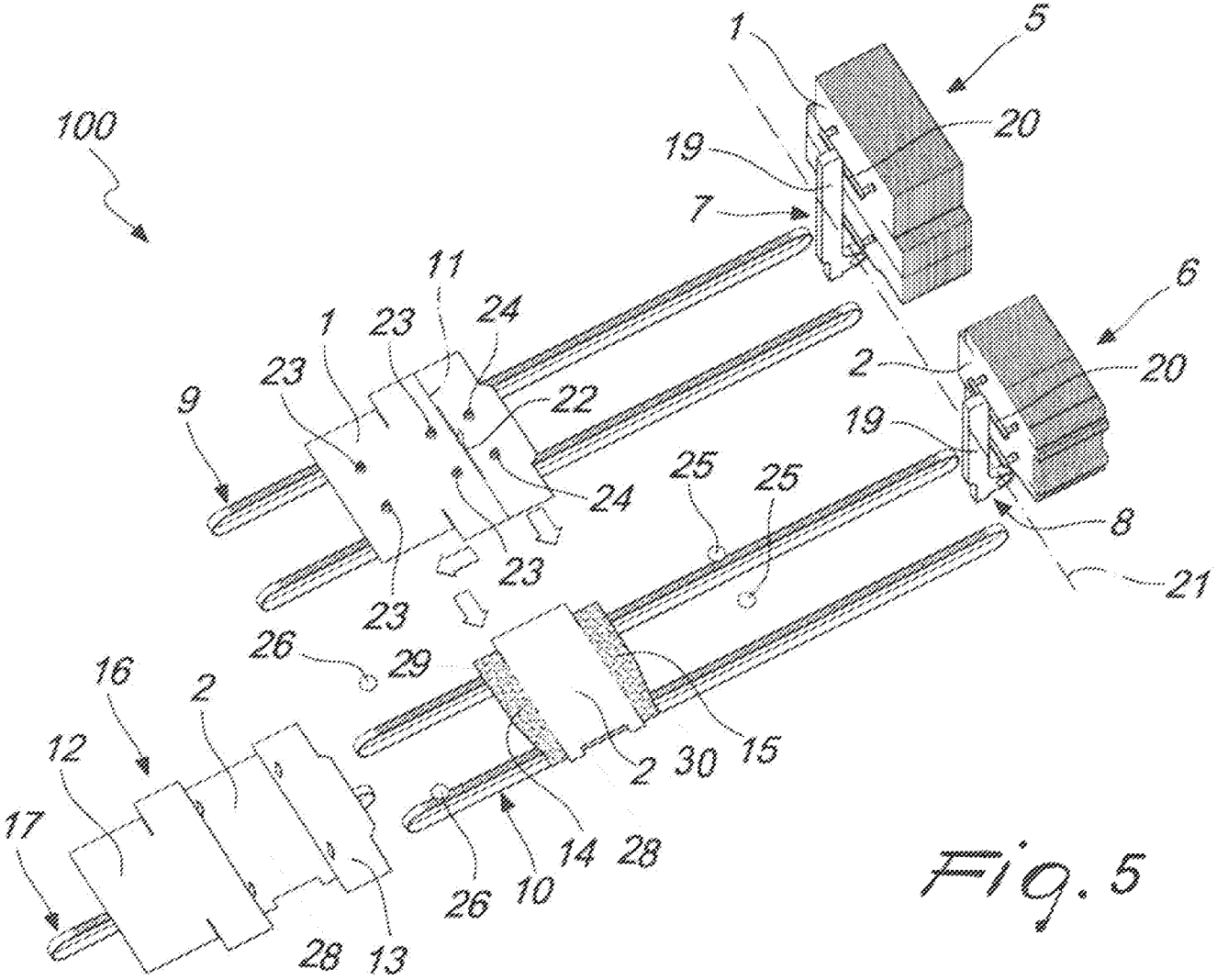
Figure 7:
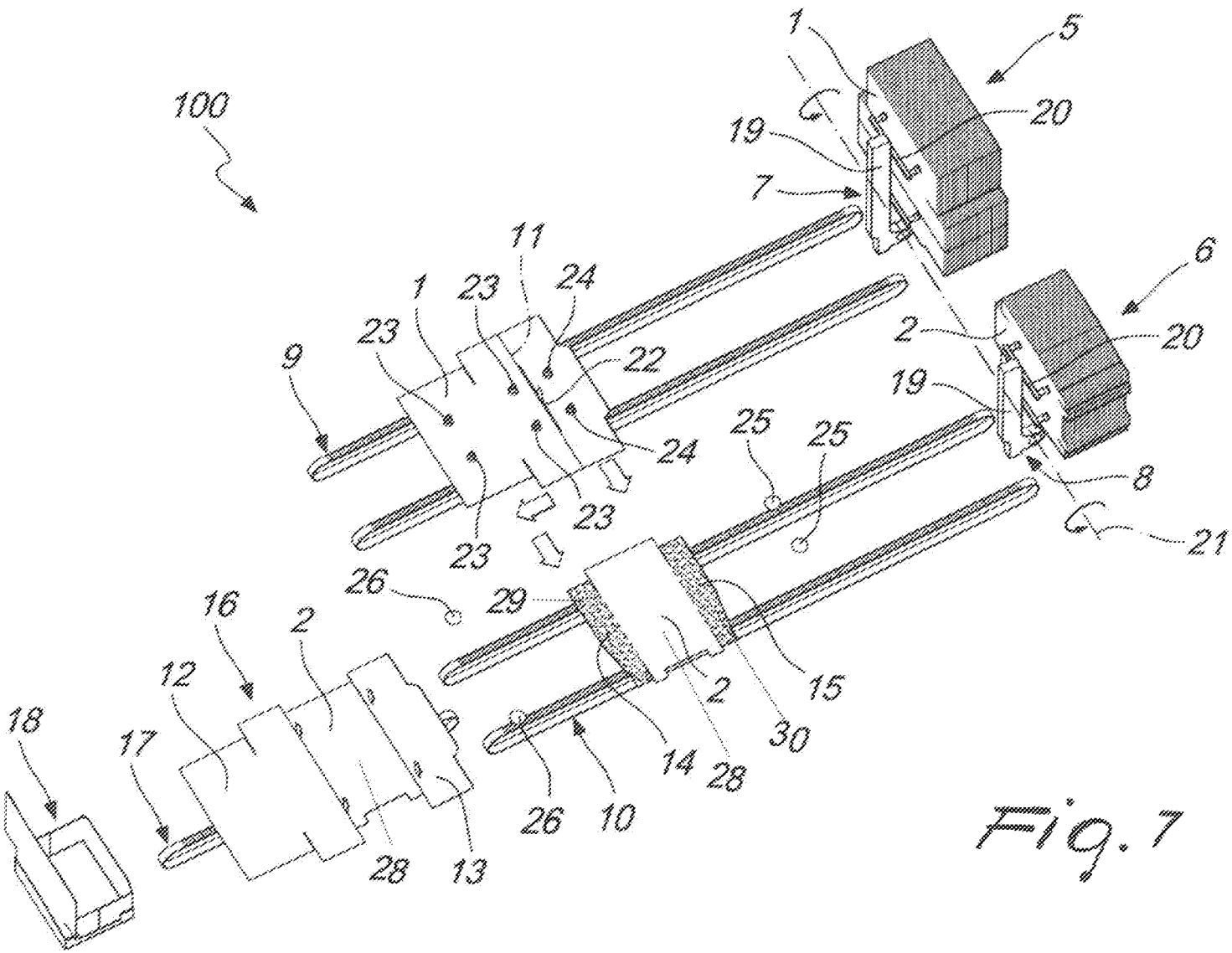

In detail, the first portion (14) is preferably comprised in one from between the first die-cut element (12) and the first lateral portion (29) of the secondary die-cut element (2) and the second portion (15) is, preferably, comprised in one from between the second die-cut element (13) and the second lateral portion (30) of the secondary die-cut element (2), see FIGS. 3, 5 and 7.

Thereafter, with particular reference to figures from 5 to 7, having obtained the desired opened die-cut element, it is unloaded via a dedicated unloading line included, in the illustrated embodiment, with the reference number (17).

Figure 6:
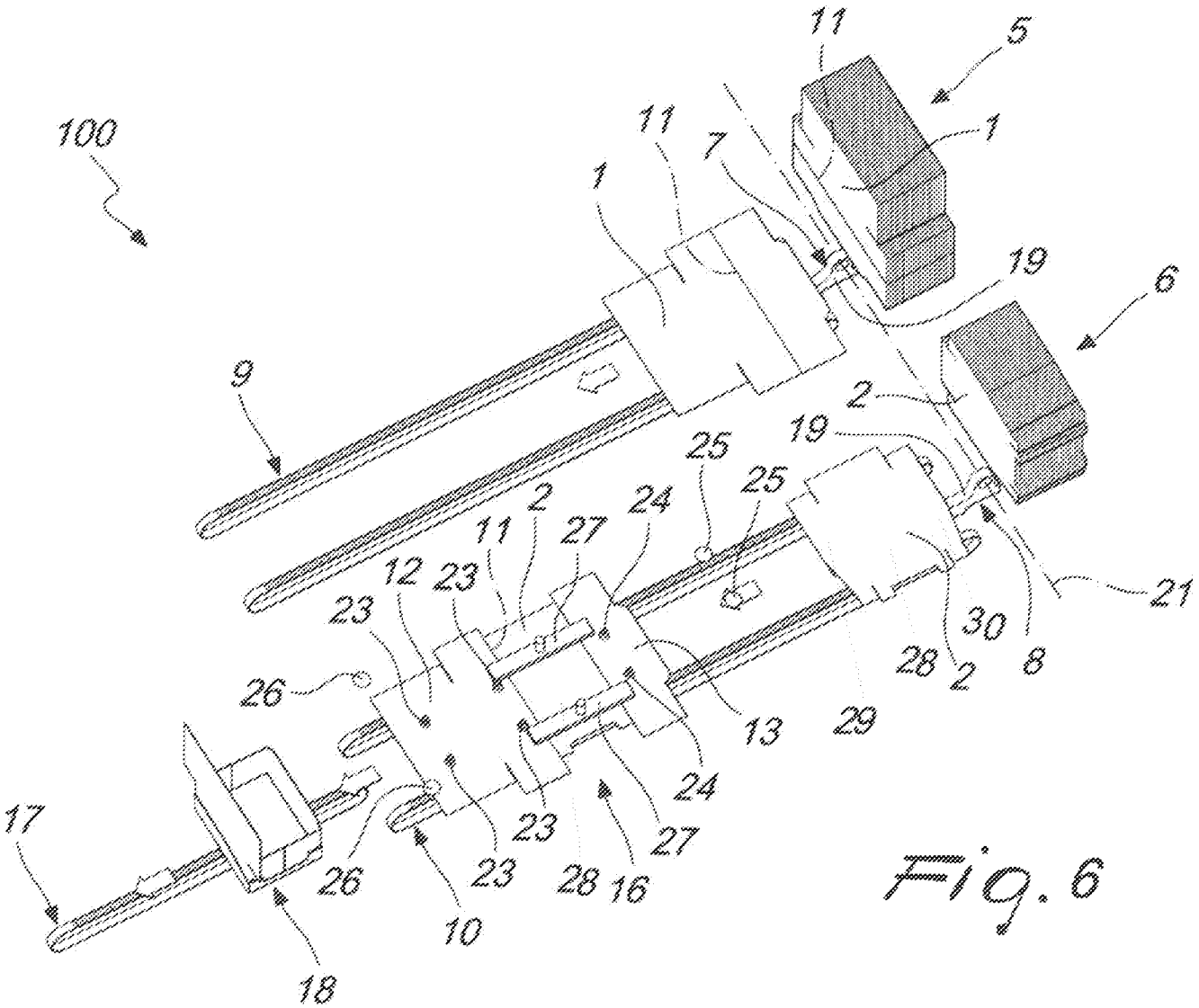

In greater detail, with particular reference to FIG. 6, the formation of the wrap-around tray plus lid box (18) along the unloading line (17).

Lastly, with particular reference to FIG. 7, the wrap-around tray plus lid box (18) is expelled from the unloading line (17).

Alternatively, the formation of the wrap-around tray plus lid box (18) can take place out of the unloading line (17), in another machine, thus providing a flat die-cut element as an output product.

Still with particular reference to the accompanying figures, the cartoning machine, operating by means of a process described in the foregoing, which is illustrated schematically and in a simplified way so as to be representative of the steps and special conceptual characteristics of the invention and which is denoted in its entirety by reference numeral (100), comprises the first store (5) and the second store (6) respectively housing a plurality of main die-cut elements (1) and a plurality of secondary die-cut elements (2).

In greater detail, the stores (5 and 6) are located parallel to one another and receive the respective die-cut elements (1 and 2) in a direction that is practically inclined with respect to the horizontal, so as to have two piles of die-cut elements (1 and 2) which advance by force of gravity as the single die-cut elements (1 and 2) are progressively picked up.

Alternatively, in variants of the embodiment that are not illustrated, the stores (5 and 6) can be made in different ways of known type. For example, they may not be parallel, they might instead receive the respective die-cut elements (1 and 2) according to a direction that is practically horizontal, have sheet-separating devices, etc.

Still with particular reference to the accompanying figures, the cartoning machine (100) preferably comprises the first advancement line (9) and the second advancement line (10).

As mentioned in the foregoing, a first pick-up and discharge device (7) of the main die-cut elements (1) is included, associated to the first store (5) and able to collect a single main die-cut element (1) and position it with a consequent release thereof on a first advancement line (9).

Likewise, a second pick-up and discharge device (8) of the secondary die-cut elements (2) is associated to the second store (6) and able to collect a single secondary die-cut element (2), and position it with a consequent release thereof on the second advancement line (10), which, as mentioned, in the illustrated embodiment is parallel to the first advancement line (9).

In the illustrated embodiment, the pick up and discharge devices (7 and 8) each comprise an articulated arm (19) or technically equivalent device equipped with a group of suckers under depression (20) and which is mobile about an axis of rotation (21) from a gripping position of the main die-cut element (1) or the secondary die-cut element (2) to a release position thereof.

Figure 2:
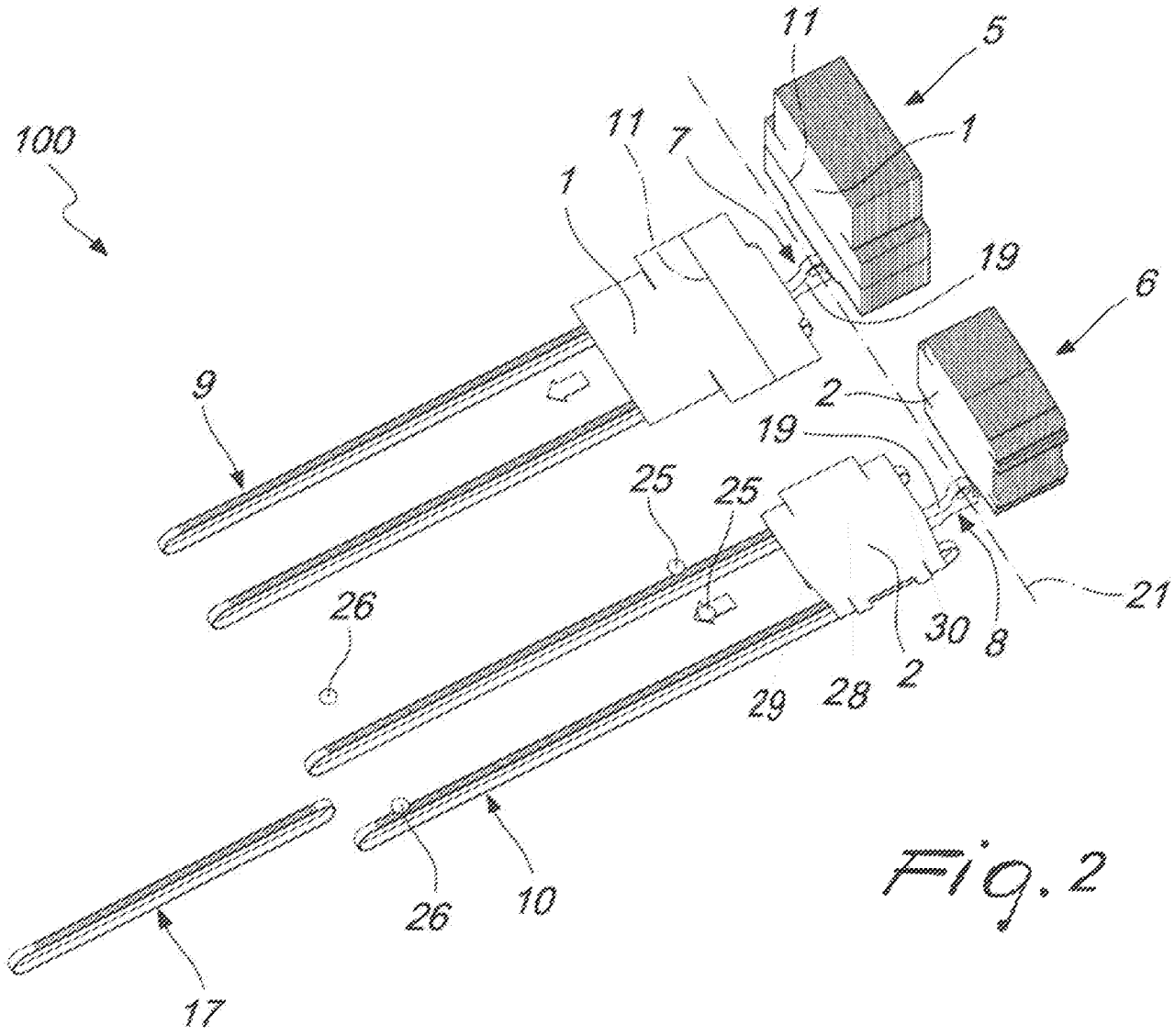

In detail, with particular reference to FIGS. 1 and 2, the articulated arm (19) is mobile about the axis of rotation (21) between a gripping position, wherein the first pick-up and discharge device (7) can pick up a single main die-cut element of the main die-cut elements (1) and the second pick-up and discharge device (8) can pick up a single secondary die-cut element (2) of the secondary die-cut elements (2) (see FIGS. 1, 3, 5, 7), and a release position, in which the articulated arm (19) of the first pick-up and discharge device (7) and the relative group of suckers under depression (20) are arranged in such a way as to be able to release the main die-cut element (1) on the first advancement line (9) and the articulated arm (19) of the second pick-up and discharge device (8) and the relative group of suckers under depression (20) are arranged in such a way as to be able to release the secondary die-cut element (2) on the second advancement line (10) (see FIGS. 2, 4, 6).

The articulated arm (19) of the first pick-up and discharge device (7) and the articulated arm (19) of the second pick-up and discharge device (8) In the release position are preferably parallel, respectively, to the extension direction of the first advancement line (9) and the extension direction of the second advancement line (10), see in particular FIGS. 2, 4 and 6.

A division station of the main die-cut element (1) can be provided along the first advancement line (9) for obtaining the first die-cut element (12) and second die-cut element (13).

In greater detail, the division station comprises a blade or mallet cutting device (22) operating on the main die-cut element (1) along the division line (11) at the same time as the grip and contrast means (80) of the main die-cut element (1).

Further provided are first glue spraying means (25) adapted to deposit glue on the first portion (14) and on the second portion (15) of said secondary die-cut element (2) advancing along the second advancement line (10) parallel to the main die-cut element (1).

A handling unit (110) Is advantageously provided of the first die-cut element (12) and the second die-cut element (13) which is constituted substantially by a gripping head (31) provided with two groups of suckers in depression (23 and 24) independent of one another.

More specifically, the handling unit (110), which also realises the grip and contrast means (80) of the main die-cut element (1) during the division step thereof is able:

- to displace the first die-cut element (12) and second die-cut element (13) from the first advancement line (9),
- to distance from one another the die-cut elements (12, 13) by the distancing of the groups of suckers (23 and 24) under depression,
- on the positioning thereof superiorly of the secondary die-cut element (2) on the second advancement line (10) In such a way that the first die-cut element (12) and the second die-cut element (13) are partly superposed on the secondary die-cut element (2) respectively at the first portion (14) and the second portion (15),
- on the depositing and release of the first die-cut element (12) and the second die-cut element (13) on the secondary die-cut element (2) In order to obtain the opened die-cut element (16).

The gripping head (31), preferably, bears a first group of suckers (23) in depression and a second group of suckers (24) in depression and it is predisposed to enable movement of the first group of suckers (23) and the second group of suckers (24) in a first direction (A) which is vertical so as to be able to pick up and release the first die-cut element (12) and the second die-cut element (13), and along a second direction (B), perpendicular to the first direction (A) and the extension direction of the first advancement line (9) and the second advancement line (10), so as to be able to displace the first die-cut element (12) and second die-cut element (13) from the first advancement line (9) to the second advancement line (10). The gripping head (31) is further predisposed to enable movement of the first group of suckers (23) and/or the second group of suckers (24) in a third direction (C), perpendicular to the first direction (A) and to the second direction (B) and parallel to the extension direction of the first advancement line (9) and of the second advancement line (10), so as to be able to distance or near the first die-cut element (12) and second die-cut element (13) from and to one another.

The cartoning machine (100), preferably, comprises a conveyor belt (34) which extends along the second direction (B); the gripping head (31) is borne by the conveyor belt (34) in order to move along the second direction (B). Further, the gripping head (31) preferably comprises at least a first gripping arm (32), which bears the first group of suckers (23), a second gripping arm (33), which bears the second group of suckers (24), a first rack (35) which extends along the third direction (C) and which bears the first gripping arm (32) or the second gripping arm (33), and a first motor (36) which moves the first rack (35) by means of a pinion (37) along the third direction (C) so as to distance or near the first group of suckers (23) and the second group of suckers (24) from or towards one another, see FIGS. 3A, 3B, 3C, 3D and 8.

Figure 8:
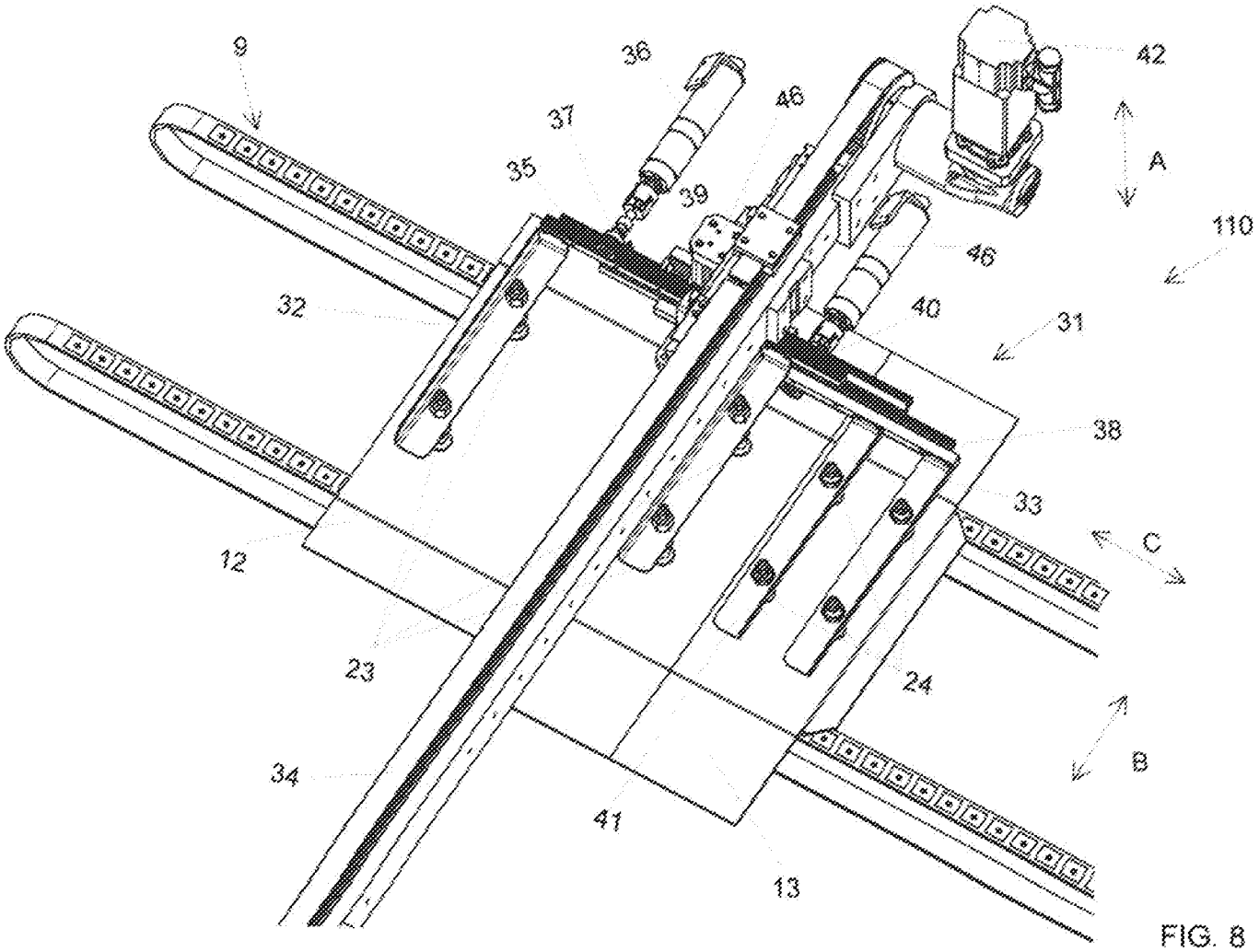
FIG. 8 illustrates a part of the cartoning machine in larger scale.

With particular reference to FIG. 8, the gripping head (31) further comprises a second rack (38) which extends along the third direction (C), and a second motor (45) which moves the second rack (38) by means of a second pinion (not illustrated) along the third direction (C) so as to distance or near the first group of suckers (23) and the second group of suckers (24) from or towards one another.

With particular reference to FIGS. 3A, 3B, 3C, 3D and 8, the first rack (35) bears the first gripping arm (32) and the second rack (38) bears the second gripping arm (33).

Further, and still with reference to FIG. 8, the conveyor belt (34) is preferably wound about a first pulley (43) connected to a third motor (42) and a second idler pulley (44).

Alternatively, in embodiments of the cartoning machine (100) that are not illustrated, the conveyor belt (34) can be replaced by a conveyor that can be activated by means of a rack, or a helix screw or a pneumatic or electrical linear actuator.

Further, with particular reference to FIGS. 3A, 3B, 3C, 3D and 8, the gripping head (31) Is, preferably, borne by the conveyor belt (34) by means of a frame (46), which is superiorly connected to the conveyor belt (34) so as to be able to slide along the conveyor belt (34), when the conveyor belt (34) is moved by the third motor (42), so as to enable the movement of the gripping head (31) along the second direction (B). The frame (46) Is further movable along the first direction (A) by a piston (39), so as to enable the movement of the gripping head (31) along a first direction (A).

Still with reference to FIGS. 3A, 3B, 3C, 3D and 8, the gripping head (31) preferably further comprises: a third gripping arm (40) which bears other suckers of the first group of suckers (23) and a fourth gripping arm (41) which bears other suckers of the second group of suckers (24).

The third gripping arm (40) Is preferably borne by the first rack (35) and the fourth gripping arm (41) is preferably borne by the second rack (38).

With particular reference to FIGS. 3A, 3B, 3C and 3D, the handling unit (110) of the cartoning machine (100), once the division of the main die-cut element (1) into the first die-cut element (12) and the second die-cut element (13) has taken place, acts to form an opened die-cut element (16) as follows: the piston (39) moves the frame (46), which bears the gripping head (31), downwards along the first direction (A) so that the first group of suckers (23) and the second group of suckers (24) grip, respectively, on the first die-cut element (12) and on the second die-cut element (13) (see FIG. 3A); the first motor (36) by means of the pinion (37), moves the first rack (35) so as to move the first gripping arm (32) and the third gripping arm (40) along the third direction (C), so as to distance or near the first group of suckers (23) and the second group of suckers (24) from or towards one another, which respectively bear the first die-cut element (12) and the second die-cut element (13), and, at the same time, the piston (39) moves the frame (46), which bears the gripping head (31), upwards along the first direction (A) so as to collect the first die-cut element (12) and the second die-cut element (13) from the first advancement line (9) (see FIG. 3B); the third motor (38) then moves the conveyor belt (34) so as to move the frame (46), which bears the gripping head (31), along the second direction (B) up to the secondary die-cut element (2) (see FIG. 3C); lastly, the piston (39) moves the frame (46), which bears the gripping head (31), downwards along the first direction (A) so as to superpose the first die-cut element (12) on the secondary die-cut element (2) at the first portion (14) and the second die-cut element (13) on the secondary die-cut element (2) at the second portion (15) (see FIG. 30).

For the purpose of enabling correct adhesion of the glued parts, presser means (27) can advantageously operate on the die-cut elements (12, 13 and 2).

With particular reference to FIGS. 4 and 6, the presser means (27) are configured and arranged to press on the first die-cut element (12) and the second die-cut element (2) at the first portion (14) so as to guarantee adhesion between the first die-cut element (12) and the secondary die-cut element (2), and on the second die-cut element (13) and the secondary die-cut element (2) at the second portion (15) so as to guarantee the adhesion between the second die-cut element (13) and the secondary die-cut element (2).

Lastly, as already mentioned, an unloading line (17) Is included along which the opened die-cut element (16) undergoes a further handling so as to be conformed into the wrap-around tray plus lid box (18) as illustrated in FIG. 6, or exits the cartoning machine (100) so as to enter a second machine in which it undergoes handling so as to be conformed into the wrap-around tray plus lid box (18).

The opened die-cut element (16) is preferably handled in such a way that the secondary die-cut element (2) forms the display tray of the wrap-around tray plus lid box (18) and the first die-cut element (12) and the second die-cut element (13) form the cover of the wrap-around tray plus lid box (18).

In the case in which the wrap-around tray plus lid box (18) is formed directly on the unloading line (17), second glue spraying means (26) are included, operating during the transit of the opened die-cut element (16) on the coupling areas.

It has been observed that the method for forming an opened die-cut element, particularly for forming a wrap-around box of the tray plus lid type, as well as the cartoning machine for realising the method according to the invention, fully carry out the task as well as attaining the predetermined aims, as they enable reducing the number of stores and consequently the devices and product advancement lines pertaining thereto in relation to the number of elements constituting the desired final die-cut element, with a considerable saving from both technical and economic points of view.

In fact, reducing the number of stores means that the machine is significantly simplified and, from a management point of view, it is possible to manage fewer component codes.

For example, consider that with known-type machines, for the creation of an opened die-cut element constituted by three pieces, it is necessary to design and supply the machine with three stores, three advancement lines and two handling groups, one for each lateral element.

With the described machine, on the other hand, all the above-cited elements can be reduced by one unit.

The invention claimed is:

1. A method for forming a die-cut element, comprising:

providing a main die-cut element and a secondary die-cut element;

dividing the main die-cut element along a predefined division line in such a way as to obtain a first die-cut element and second die-cut element that are mutually distinct, wherein grip and contrast means retain the main die-cut element during division thereof into the first die-cut element and into the second die-cut element;

depositing glue on a first portion of one of the first die-cut element and the secondary die-cut element and on a second portion of one of the second die-cut element and the secondary die-cut element;

forming an opened die-cut element of the tray plus lid type provided by the combination of said first die-cut element and of said second die-cut element, wherein:

the first die-cut element and the second die-cut element are coupled to the secondary die-cut element with the first die-cut element and the secondary die-cut element partly superposed and pressed to one another at the first portion and the second die-cut element and the secondary die-cut element partially superposed and pressed to one another at the second portion;

the depositing of the glue is carried out prior to the forming of the opened die-cut element;

the main die-cut element is retained by a handling unit comprising a gripping head that bears a first group of suckers and a second group of suckers during the dividing the main die-cut element; and the gripping, head is predisposed to enable movement of the first group of suckers and the second group of suckers so as to distance or approximate the first die-cut element and the second die-cut element to one another prior to the forming an opened die-cut element.

2. The method of claim 1, wherein the dividing of the main die-cut element comprises cutting the main die-cut element along the predefined division line.

3. The method of claim 1 wherein the dividing of the main die-cut element comprises the tearing of the main die-cut element along the predefined division line, the main die-cut element being partially pre-cut along the predefined division line so as to facilitate tearing.

4. The method of claim 1, wherein the secondary die-cut element comprises a central portion, a first lateral portion, and a second lateral portion, opposite the first lateral portion; wherein the first die-cut element couples with the secondary die-cut element by means of relative superposing between the first die-cut element and the first lateral portion; and wherein the second die-cut element couples with the secondary die-cut element by means of relative superposing between the second die-cut element and the second lateral portion.

5. A cartoning machine comprising:

a first store housing a plurality of main die-cut elements;

a first pick-up and discharge device of the main die-cut elements associated with the first store and adapted to pick up a single die-cut element of the main die-cut elements and position the same with a consequent release thereof on a first advancement line oriented in an extension direction;

a division station dividing each single die-cut element of the main die-cut elements along a predefined division line to obtain a first die-cut element and a second die-cut element that are mutually distinct;

a second store housing a plurality of secondary die-cut elements;

a second pick-up and discharge device of the secondary die-cut elements associated with the second store and adapted to pick up a single die-cut element of the secondary die-cut elements and position and release the same on a second advancement line oriented parallel to and in the extension direction of the first advancement line;

first glue spraying means adapted to deposit glue on one of the first die-cut element and the secondary die-cut element and on one of the second die-cut element and said secondary die-cut element;

a handling unit of the first die-cut element and the second die-cut element adapted to pick up the first die-cut element and the second die-cut element, adapted to reciprocally distance the first die-cut element and the second die-cut element, adapted to position the first die-cut element and the second die-cut element superiorly of the secondary die-cut element so that the first die-cut element and the second die-cut element are partially superposed on the secondary die-cut element and adapted to deposit and release the first die-cut element and the second die-cut element on the secondary die-cut element in order to obtain an opened die-cut element, wherein:

the handling unit comprises a gripping head that bears a first group of suckers and a second group of suckers;

the gripping head is predisposed to enable movement of the first group of suckers and the second group of suckers in a vertical first direction so as to be able to pick up and release the first die-cut element and second die-cut element, and along a second direction, perpendicular to the first direction and the extension direction of the first advancement line and of the second advancement line, so as to be able to displace the first die-cut element and second die-cut element from the first advancement line to the second advancement line; and the gripping head is further predisposed to enable movement of the first group of suckers and/or the second group of suckers in a third direction, perpendicular to the first direction and to the second direction and parallel to the extension direction of the first advancement line and of the second advancement line, so as to be able to distance or approximate the first die-cut element and the second die-cut element to one another.

6. The cartoning machine of claim 5, wherein the first pick-up and discharge device and the second pick-up and discharge device each comprise an articulated arm which bears a group of suckers and which is mobile about an axis of rotation between a gripping position, wherein the first pick-up and discharge device can pick up a single main die-cut element of the main die-cut elements and the second pick-up and discharge device can pick up a single secondary die-cut element of the secondary die-cut elements, and a release position, wherein the articulated arm of the first pick-up and discharge device and the respective group of suckers are arranged to release the main die-cut element on the first advancement line and the articulated arm of the second pick-up and discharge device and the relative group of suckers are arranged to release the secondary die-cut element on the second advancement line.

7. The cartoning machine of claim 5, wherein the division station of the main die-cut element comprises a blade or mallet cutting device.

8. The cartoning machine according to claim 5, wherein:

the first group of suckers is kept under depression and the second group of suckers is kept under depression.

9. The cartoning machine of claim 5, further comprising a conveyor belt which extends along the second direction;

the gripping head being borne by the conveyor belt in order to move along the second direction;

the gripping head comprising at least a first gripping arm, which bears the first group of suckers, a second gripping arm, which bears the second group of suckers, a first rack which extends along the third direction and which bears the first gripping arm or the second gripping arm, and a first motor which moves the first rack by means of a pinion along the third direction so as to distance or near the first group of suckers and the second group of suckers from or towards one another.

10. The cartoning machine according to claim 5, further comprising presser means that are configured and arranged to press on the first die-cut element and the secondary die-cut element and on the second die-cut element and the secondary die-cut element.

11. A cartoning machine, operating using a method according to claim 1, the cartoning machine comprising:

a first store housing a plurality of the main die-cut element;

a first pick-up and discharge device of the main die-cut elements associated to the first store and adapted to pick up a single die-cut element of the main die-cut elements and a positioning thereof with a consequent release thereof on a first advancement line;

a division station of the main die-cut element in order to obtain the first die-cut element and the second die-cut element;

a second store housing a plurality of the secondary die-cut element;

a second pick-up and discharge device of the secondary die-cut elements associated to the second store and adapted to pick up a single die-cut element of the secondary die-cut elements and position and release the single die-cut element on a second advancement line;

first glue spraying means adapted to deposit glue on said first portion and on said second portion of said secondary die-cut element; and a handling unit of the first die-cut element and the second die-cut element adapted to pick up the first die-cut element and the second die-cut element, adapted to reciprocally distance the first die-cut element and the second die-cut element, adapted to position the first die-cut element and the second die-cut element superiorly of the secondary die-cut element so that the first die-cut element and the second die-cut element are partially superposed on the secondary die-cut element respectively at the first portion and at the second portion and adapted to deposit and release the first die-cut element and the second die-cut element on the secondary die-cut element in order to obtain the opened die-cut element, wherein:

the first pick-up and discharge device and the second pick-up and discharge device each comprise an articulated arm which bears a group of suckers under depression and which is mobile about an axis of rotation between a gripping position;

the first pick-up and discharge device can pick up a single main die-cut element of the main die-cut elements and the second pick-up and discharge device can pick up a single secondary die-cut element of the secondary die-cut elements, and a release position; and the articulated arm of the first pick-up and discharge device and the relative group of suckers under depression are arranged in such a way as to be able to release the main die-cut element on the first advancement line and the articulated arm of the second pick-up and discharge device and the relative group of suckers under depression are arranged in such a way as to be able to release the secondary die-cut element on the second advancement line.

* * * * *